US009634367B2

(12) United States Patent
Cai et al.

(10) Patent No.: US 9,634,367 B2
(45) Date of Patent: Apr. 25, 2017

(54) FILTER

(71) Applicant: HUAWEI TECHNOLOGIES CO., LTD., Shenzhen (CN)

(72) Inventors: Dantao Cai, Shenzhen (CN); Peiyong Cao, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 166 days.

(21) Appl. No.: 14/299,258

(22) Filed: Jun. 9, 2014

(65) Prior Publication Data

US 2014/0285288 A1 Sep. 25, 2014

Related U.S. Application Data

(63) Continuation of application No. PCT/CN2011/083677, filed on Dec. 8, 2011.

(51) Int. Cl.

| | |
|---|---|
| ***H01P 1/203*** | (2006.01) |
| ***H01P 1/202*** | (2006.01) |
| ***H01P 7/04*** | (2006.01) |
| ***H01P 1/205*** | (2006.01) |

(52) U.S. Cl.

CPC ..... *H01P 1/20336* (2013.01); *H01P 1/202* (2013.01); *H01P 1/205* (2013.01); *H01P 7/04* (2013.01)

(58) Field of Classification Search

CPC ..... H01P 7/04; H01P 1/202; H01P 1/20336; H01P 1/20327; H01P 1/205; H01P 1/2053

USPC ..... 333/204, 206, 207, 222, 223, 219, 235

See application file for complete search history.

(56) References Cited

U.S. PATENT DOCUMENTS 2,201,199 A * 5/1940 Peterson ..... H03B 5/1835 330/55

5,939,958 A 8/1999 Grounds, III et al.

(Continued)

FOREIGN PATENT DOCUMENTS

| | | |
|---|---|---|
| CN | 1581568 | 2/2005 |
| CN | 1694302 | 11/2005 |

(Continued)

OTHER PUBLICATIONS

Chinese Office Action dated Aug. 19, 2013 in corresponding Chinese Patent Application No. 201180003157.4.

(Continued)

*Primary Examiner* — Stephen E Jones
*Assistant Examiner* — Rakesh Patel
(74) *Attorney, Agent, or Firm* — Staas & Halsey LLP

(57) ABSTRACT

Embodiments of the present invention disclose a filter, including: a conductive box body, and an insulating substrate, a first conductor, and a second conductor that are arranged inside the conductive box body. The insulating substrate includes a first surface and a second surface. The first conductor is arranged on the first surface of the insulating substrate. A position on the second surface corresponding to the first conductor contacts with the conductive box body. The second conductor is arranged on the first surface or the second surface of the insulating substrate. The second conductor and the conductive box body form a coaxial resonant cavity together. Further, an end of the second conductor is coupled with the first conductor, and the other end of the second conductor is coupled with the conductive box body. The filter has advantages of a microstrip filter of simple manufacturing process and small volume.

10 Claims, 4 Drawing Sheets

(56) References Cited

U.S. PATENT DOCUMENTS

| | | | | |
|---|---|---|---|---|
| 2008/0024249 | A1 | 1/2008 | Schreibvogel | |
| 2009/0027351 | A1 | 1/2009 | Zhang et al. | |
| 2009/0128263 | A1 * | 5/2009 | Hesselbarth ..... | H01P 1/20327 333/230 |

FOREIGN PATENT DOCUMENTS

| | | |
|---|---|---|
| CN | 101420056 | 4/2009 |
| CN | 100578855 | 1/2010 |
| CN | 102176525 | 9/2011 |
| EP | 2056394 A1 | 5/2009 |

OTHER PUBLICATIONS

European Office Action dated Oct. 20, 2014 in corresponding European Patent Application No. 11867197.3.
Extended European Search Report dated Jul. 11, 2014 in corresponding European Patent Application No. 11867197.3.
PCT International Search Report dated Aug. 23, 2012 in corresponding International Patent Application No. PCT/CN2011/083677.
Book/Software Reviews, "Theory and Design of Microwave Filters" by I.C. Hunter, IEEE Microwave Magazine, Sep. 2001, 1 page.
Hong et al., "Microstrip Filters for RF/Microwave Applications", John Wiley & Sons, Inc, © 2001, 476 pp.
International Search Report mailed Aug. 23, 2012, in corresponding International Patent Application No. PCT/CN2011/083677.

* cited by examiner

FILTER

CROSS-REFERENCE TO RELATED APPLICATIONS

This application is a continuation of International Application No. PCT/CN2011/083677, filed on Dec. 8, 2011, which is hereby incorporated by reference in its entirety.

TECHNICAL FIELD

Embodiments of the present invention relate to the field of electronic and circuit components, and in particular, to a filter.

BACKGROUND

A filter is widely used in the modern communications field, and a basic function thereof is: making useful signals pass on a signal link to the greatest extent, and restraining harmful signals to the greatest extent.

There are a wide variety of common filters, which mainly include: microstrip filter, strip line filter, and coaxial cavity filter.

The microstrip filter is formed by microstrips, where the microstrips are printed wires separated by dielectrics on a ground plane, that is, printed wires laid on a side of the dielectrics, and grounding metal is disposed at a position on the other side corresponding to the printed wires. Since the microstrip filter is simple in structure and manufacturing process and small in volume, it is widely used in various communication circuits, but it has defects of large insertion loss and small power capacity.

The coaxial cavity filter is widely applied to systems of communication and radar, and generally includes standard coaxial and square cavity coaxial based on different cavity structures. The coaxial cavity filter has features such as high Q value, easy implementation, small insertion loss, and large power capacity. This type of filter is very suitable for mass production, and therefore, the cost is very low. However, when the coaxial cavity filter is used above 10 GHz, it is hard to achieve manufacturing precision because of its tiny physical size, resulting in difficulty of batch consistency of indexes such as filter standing wave, phase, and group delay.

SUMMARY

Embodiments of the present invention provide a filter, which overcomes defects in a current microstrip filter of large insertion loss and small power capacity.

In order to achieve the above objective, the following technical solution is adopted in the embodiments of the present invention.

A filter includes: a conductive box body, and an insulating substrate, a first conductor, and a second conductor that are arranged inside the conductive box body, where the insulating substrate includes a first surface and a second surface, the first conductor is arranged on the first surface of the insulating substrate, a position on the second surface corresponding to the first conductor contacts with the conductive box body, the second conductor is arranged on the first surface or the second surface of the insulating substrate, the second conductor and the conductive box body form a coaxial resonant cavity together, an end of the second conductor is coupled with the first conductor, and the other end of the second conductor is coupled with the conductive box body.

In the filter provided by the embodiments of the present invention, the first conductor is arranged on the first surface of the insulating substrate, and the position on the second surface of the insulating substrate corresponding to the first conductor contacts with the grounded conductive box body. In addition, the second conductor and the conductive box body form the coaxial resonant cavity together, and an end of the second conductor is coupled with the first conductor. Therefore, the filter is formed into a structure of a combination of a microstrip and a coaxial resonant cavity, and not only has advantages of the microstrip filter of simple manufacturing process and small volume, but also further has advantages of the coaxial cavity filter of high Q (power factor) value, small insertion loss, and large power capacity.

BRIEF DESCRIPTION OF DRAWINGS

To describe the technical solutions in the embodiments of the present invention more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

Figure 1:
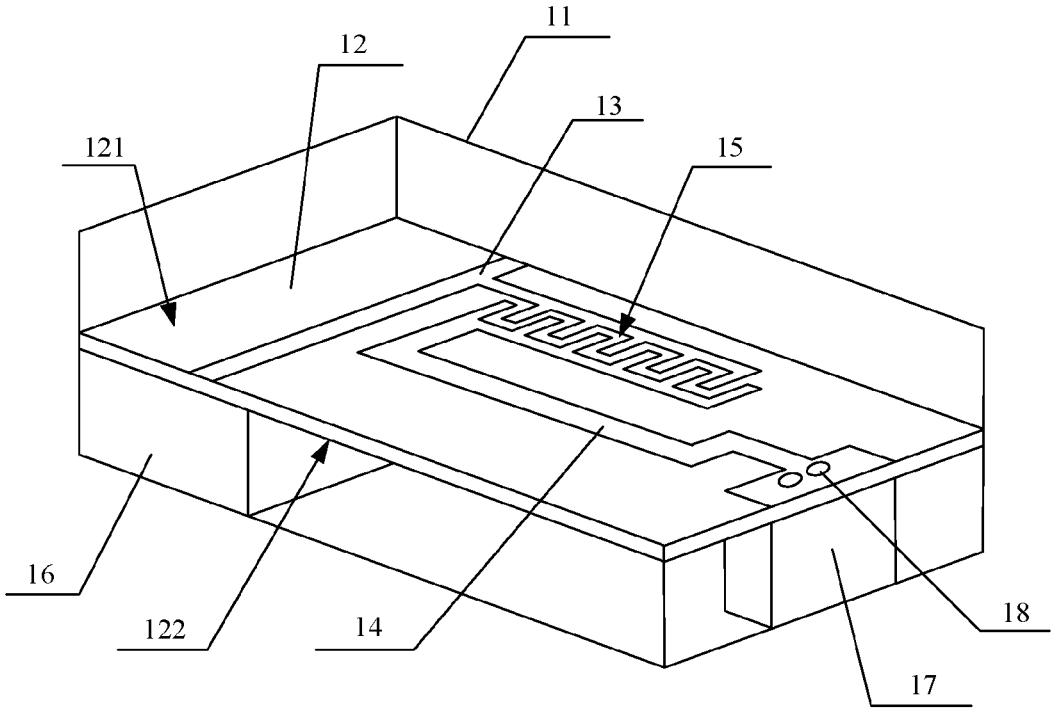
FIG. 1 is a stereo view of a structure of a filter according to an embodiment of the present invention.

Embodiments of the present invention provide a filter. As shown in FIG. 1, to clearly show an internal structure of the filter, FIG. 1 is a structural diagram of the filter after removing two side walls of a conductive box body. The filter shown in FIG. 1 includes: a conductive box body 11, and an insulating substrate 12, a first conductor 13, and a second conductor 14 that are arranged inside the conductive box body 11. The insulating substrate 12 includes a first surface 121 and a second surface 122. The first conductor 13 is arranged on the first surface 121 of the insulating substrate 12. A position on the second surface 122 corresponding to the first conductor 13 contacts with the conductive box body 11. The second conductor 14 is arranged on the first surface 121 or the second surface 122 of the insulating substrate 12. The second conductor 14 and the conductive box body 11 form a coaxial resonant cavity together. Further, an end of the second conductor 14 is coupled with the first conductor 13, and the other end of the second conductor 14 is coupled with the conductive box body 11.

A coupling manner between the second conductor 14 and the conductive box body 11 may include: capacitive coupling, inductive coupling, or current coupling, and a coupling manner between the second conductor 14 and the first conductor 13 may include: capacitive coupling, inductive coupling, or current coupling.

The capacitive coupling refers to: coupling by using a capacitor formed in a gap between two parts when the two parts contact with each other in a nonmetallic manner. The inductive coupling refers to: coupling by using a magnetic field between two parts when the two parts contact with each other in a nonmetallic manner. The current coupling refers to: forming a current path when the two parts contact with each other in a metallic manner. If coupling manners are different, in an equivalent circuit of the filter, the first conductor 13 and the second conductor 14 are electrically connected or the second conductor 14 and the ground (grounded conductive box body 11) are electrically connected by using different circuit elements. For example, when the first conductor 13 and the second conductor 14 are capacitance-coupled, the first conductor 13 and the second conductor 14 are electrically connected by using a capacitor; when the first conductor 13 and the second conductor 14 are inductance-coupled, the first conductor 13 and the second conductor 14 are electrically connected by using an inductor; when the first conductor 13 and the second conductor 14 are current-coupled, the first conductor 13 and the second conductor 14 are electrically connected by using a wire; and when the second conductor 14 and the ground are current-coupled, an end of the second conductor 14 is directly grounded.

Certainly, in addition to the foregoing coupling manners, the first conductor 13 and the second conductor 14 or the second conductor 14 and the ground (the grounded conductive box body 11) may also be coupled in other coupling manners known by a person skilled in the art.

When the filter is being used, the conductive box body 11 is grounded, the first conductor 13 is arranged on the first surface 121 of the insulating substrate 12, and the position on the second surface 122 corresponding to the first conductor 13 contacts with the conductive box body 11. Therefore, the first conductor 13 is a microstrip. In addition, the second conductor 14 and the conductive box body 11 form the coaxial resonant cavity together, and an end of the second conductor 14 is coupled with the first conductor 13, so that the filter is formed into a structure of a combination of a microstrip and a coaxial resonant cavity, and not only has advantages of the microstrip filter of simple manufacturing process and small volume, but also has advantages of the coaxial cavity filter of high Q (power factor) value, small insertion loss, and large power capacity.

Meanwhile, because an inner conductor (the second conductor 14) of the coaxial resonant cavity is directly formed on the insulating substrate 12, high consistency of a board making technology of a printed circuit board (Printed Circuit Board, PCB for short) is used to enable the filter to have batch consistency of indexes.

Further, the insulating substrate 12 may have a relatively high dielectric constant, and therefore, when compared with an air strip line, the insulating substrate 12 can reduce a volume of the filter. The air strip line may be understood as a "board" made of a material of air with a metal conductor laid thereon. The volume of this type of "board" is relatively large because the dielectric constant of this type of "board" is 1.

In the filter, the coaxial resonant cavity is formed by the second conductor 14 and the conductive box body 11. Therefore, the second conductor 14 is located at a central axis of the conductive box body 11, and extends along the central axis. A space between the second conductor 14 and the conductive box body 11 is a cavity. The second conductor 14 functions as the inner conductor of the coaxial resonant cavity; and the conductive box body functions as an outer conductor of the coaxial resonant cavity.

Figure 2A:
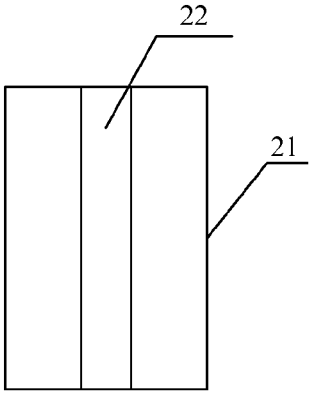
FIG. 2*a* to FIG. 2*c* are schematic diagrams of three position relationships between inner and outer conductors in a coaxial resonant cavity.
Figure 2B:
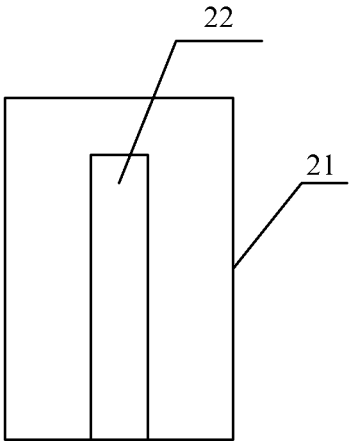
Figure 2C:
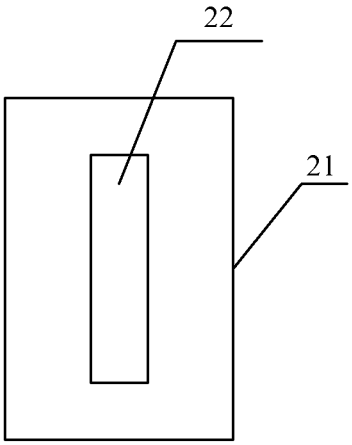

In the coaxial resonant cavity, the inner conductor may be arranged in three manners, and FIG. 2*a* to FIG. 2*c* respectively show the three manners. In FIG. 2*a*, both ends of an inner conductor 22 contact with an outer conductor 21. In FIG. 2*b*, only one end of two ends of the inner conductor 22 contacts with the outer conductor 21. In FIG. 2*c*, neither end of the inner conductor 22 contacts with the outer conductor 21. When an end of the inner conductor 22 contacts with the outer conductor 21, it is equivalent that the end of the inner conductor 22 is current-coupled with the outer conductor 21, and when the end of the inner conductor 22 does not contact with the outer conductor 21, it is equivalent that the end of the inner conductor 22 is capacitance-coupled or inductance-coupled with the outer conductor 21.

The coupling manner determines coupling strength between the second conductor 14 and the conductive box body 11, and the coupling strength further determines a resonant frequency of the coaxial resonant cavity. Certainly, factors that determine the resonant frequency further include an electrical length of the inner conductor.

In the filter shown in FIG. 1, the first conductor 13 and the second conductor 14 are capacitance-coupled by using an interdigitated structure 15. Certainly, the first conductor 13 and the second conductor 14 may also be capacitance-coupled in another manner. Adjustment of parameters, such as a line width, an interval, and an interdigitated number of the interdigitated structure 15, may affect the coupling strength between the end of the second conductor 14 coupled with the first conductor 13 and the conductive box body 11 can be affected, thereby affecting the resonant frequency of the coaxial resonant cavity.

According to the foregoing description: the first conductor 13 arranged on the first surface 121 of the insulating substrate 12 is a microstrip. Therefore, the position on the second surface 122 of the insulating substrate 12 corresponding to the first conductor 13 should contact with the grounded conductive box body 11, so as to make the position grounded. The first conductor 13 has a certain width and length. Therefore, the position on the second surface 122 of the insulating substrate 12 corresponding to the first conductor 13 is a plane rather than a point, so that the foregoing contact becomes plane contact.

FIG. 1 shows a case where the position on the second surface 122 of the insulating substrate 12 corresponding to the first conductor 13 contacts with the conductive box body 11 through a first conductive protrusion 16. Certainly, the contacting manner is not limited thereto. A conductor that covers the position on the second surface 122 of the insulating substrate 12 corresponding to the first conductor 13 may also be disposed at the position, and an end of the conductor extends to a surface of the conductive box body 11 to contact with the conductive box body 11. Other contacting manners known by a person skilled in the art may also be adopted.

The first conductive protrusion 16 may be integrally molded with the conductive box body, and a structure thereof is not limited to the structure shown in FIG. 1.

The filter in FIG. 1 further includes a second conductive protrusion 17, and a through hole 18 exists on the insulating substrate 12. The other end of the second conductor 14 contacts with the conductive box body 11 through the through hole 18 and the second conductive protrusion 17. In this type of contacting manner, current coupling is formed between the second conductor 14 and the conductive box body 11. Certainly, the contacting manner is not limited thereto, and the other end of the second conductor 14 may also directly extend to the surface of the conductive box body 11 to contact with the conductive box body 11. Other contacting manners known by a person skilled in the art may also be adopted.

The second conductive protrusion 17 may be integrally molded with the conductive box body 11, and a structure thereof is not limited to the structure shown in FIG. 1.

In addition, the second conductor 14 may be located on the first surface 121 of the insulating substrate 12, that is, on the surface same as that of the first conductor 13 (as shown in FIG. 1), and the second conductor 14 may also be located on the second surface 122 of the insulating substrate 12, that is, on the surface different from that of the first conductor 13. Certainly, compared with the second manner, the first manner may simplify the manufacturing process of the filter. FIG. 3*b* shows a side view of the filter when the second conductor 14 is located on the second surface 122 of the insulating substrate 12. Reference numerals in FIG. 1 are still used for parts in FIG. 3*b* that are the same as those in FIG. 1, where the interdigitated structure 15 in FIG. 1 is omitted, and the insulating substrate 12 is between an end of the second conductor 14 and the first conductor 13, to form a coupling capacitor, so that the coupling manner between the end of the second conductor 14 and the first conductor 13 is capacitive coupling. The other end of the second conductor 14 directly contacts with the second conductive protrusion 17, so that current coupling is formed between the other end of the second conductor 14 and the conductive box body 11, thereby omitting a step of forming the through hole 18 shown in FIG. 1 on the insulating substrate 12.

In the foregoing filter, the conductive box body 11 may be made of a metal material, or be made of a non-metal material with metal plating. The first conductor 13 may be a strip conductor or in another shape. The second conductor may also be a strip conductor or in another shape. The conductive box body 11 may be a cuboid or in another shape having a symmetrical structure. Parameters, such as a shape and a length of the first conductor 13, a shape and a length of the second conductor 14, the coupling manner between the first and second conductors, and the coupling manners respectively between the second conductor 14 and the first conductor 13, and the second conductor 14 and the conductive box body 11, determine filtering performance of the filter.

Figure 3A:
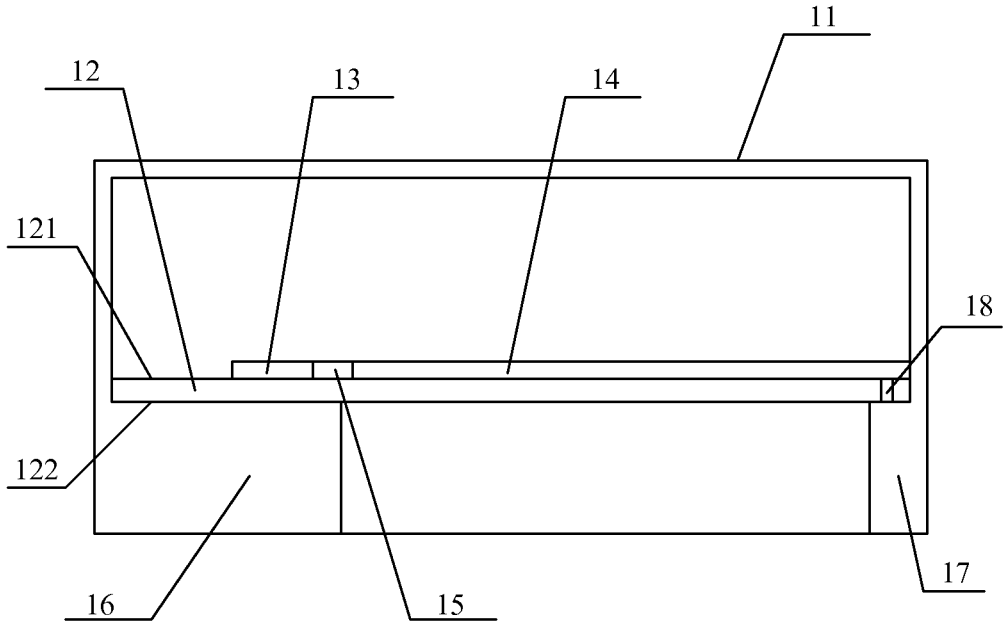
FIG. 3*a* is a side view of the filter shown in FIG. 1.
Figure 3B:
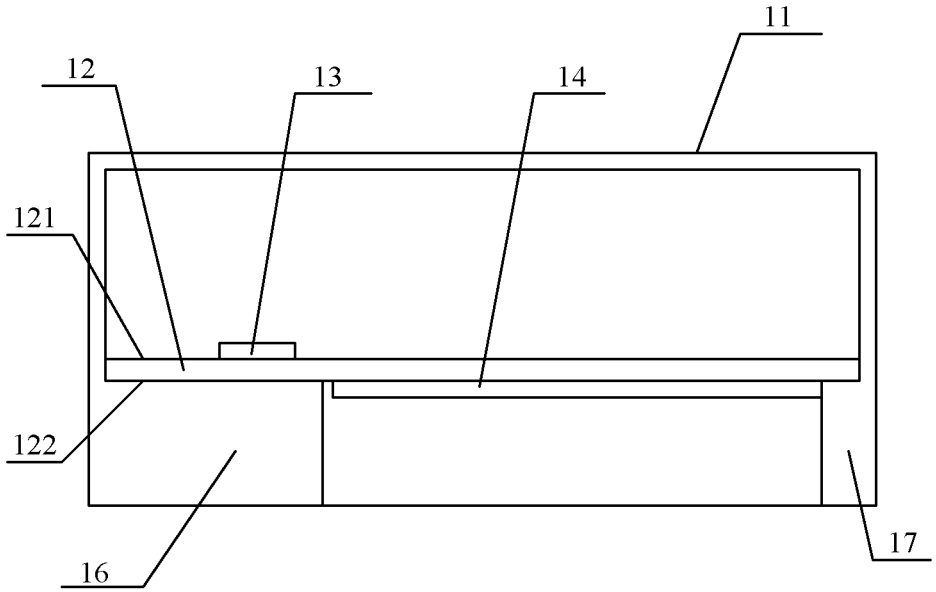
FIG. 3*b* is a side view of the filter where a second conductor is formed on a second surface of an insulating substrate.

FIG. 3*a* is a side view of FIG. 1, and reference numerals in FIG. 1 are still used for parts in FIG. 3*a* that are the same as those in FIG. 1. It can be seen that when the filter is in operation, an electromagnetic field generated by the coaxial resonant cavity is distributed in an air medium between the inner conductor (the second conductor 14) and the outer conductor (the conductive box body 11). The air medium may be considered to be a lossless medium with a large space, and therefore insertion loss is small. If the coaxial resonant cavity structure is not adopted but a micro-strip resonant cavity structure is adopted (the second surface 122 of the insulating substrate 12 under the second conductor 14 is wholly laid with a metal layer, and is grounded), the electromagnetic field is constrained in the lossy insulating substrate, and the insertion loss increases.

Figure 4:
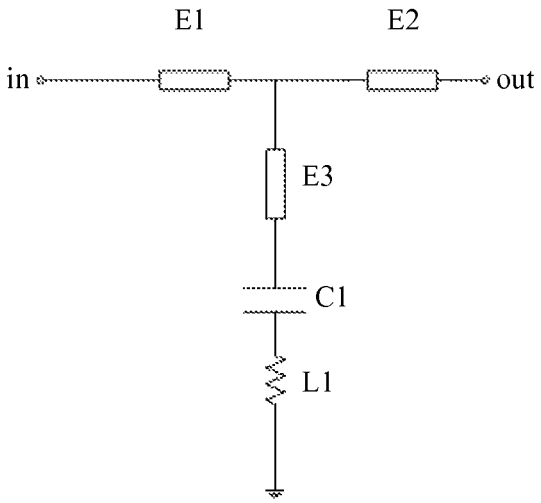
FIG. 4 is an equivalent circuit diagram of the filter shown in FIG. 1.

FIG. 4 is an equivalent circuit diagram of the filter in FIG. 1. A transmission line E1 and a transmission line E2 are equivalent circuit components of the first conductor 13. A transmission line E3 and a capacitor C1 in series connection form an equivalent circuit at a coupling point between the first conductor and the second conductor. An inductor L1 is an equivalent circuit component of the second conductor. The transmission lines are equivalent circuit components having a certain characteristic impedance and electrical length.

When the foregoing filter is being used, a signal to be filtered is connected to a port in (an end of the first conductor), and a filtered signal is output from a port out (the other end of the first conductor).

The embodiments of the present invention are mainly used in a circuit that needs to extract and detect a signal in a particular frequency band in a communication system.

The foregoing descriptions are merely specific embodiments of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A filter, comprising:

a conductive box body; and an inner portion disposed inside the conductive box body and having not more than two conductive layers, the inner portion comprising:

an insulating substrate, a first conductor, and a second conductor that are arranged inside the conductive box body, wherein:

the insulating substrate comprises a first surface and a second surface;

the first conductor is arranged on the first surface of the insulating substrate, and a position on the second surface corresponding to the first conductor contacts with the conductive box body; and the second conductor is arranged on the first surface or the second surface of the insulating substrate, the second conductor and the conductive box body form a coaxial resonant cavity together, an end of the second conductor is coupled with the first conductor, and the other end of the second conductor is coupled with the conductive box body.

2. The filter according to claim 1, wherein a coupling manner between the second conductor and the conductive box body and a coupling manner between the second conductor and the first conductor comprise one or a combination of: capacitive coupling, inductive coupling, or current coupling.

3. The filter according to claim 2, wherein an end of the second conductor is capacitance-coupled with the first conductor by using an interdigitated structure.

4. The filter according to claim 1, wherein the position on the second surface corresponding to the first conductor contacts with the conductive box body through a first conductive protrusion.

5. The filter according to claim 4, wherein the first conductive protrusion and the conductive box body are integrally molded.

6. The filter according to claim 1, further comprising a second conductive protrusion, wherein a through hole exists on the insulating substrate, and the other end of the second conductor contacts with the conductive box body through the through hole and the second conductive protrusion.

7. The filter according to claim 6, wherein, the second conductive protrusion and the conductive box body are integrally molded.

8. The filter according to claim 1, wherein the conductive box body is made of a metal material, or is made of a non-metal material with metal plating.

9. The filter according to claim 1, wherein the first conductor and/or the second conductor is a strip conductor.

10. The filter according to claim 1, wherein the conductive box body is a cuboid.

* * * * *